US006322319B1

(12) United States Patent
Yoshioka

(10) Patent No.: US 6,322,319 B1
(45) Date of Patent: Nov. 27, 2001

(54) ELECTRIC FUEL PUMP

(75) Inventor: Hiroshi Yoshioka, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/632,608

(22) Filed: Aug. 4, 2000

Related U.S. Application Data

(63) Continuation of application No. PCT/JP98/05981, filed on Dec. 28, 1998.

(51) Int. Cl.[7] ..... F04D 5/00
(52) U.S. Cl. ..... 415/55.1
(58) Field of Search ..... 415/55.1, 55.2, 415/55.3, 55.4, 55.5, 55.6, 55.7

(56) References Cited

U.S. PATENT DOCUMENTS

| | | | | |
|---|---|---|---|---|
| 3,915,589 | * | 10/1975 | Vander Linden | 415/55.4 |
| 4,141,674 | * | 2/1979 | Schonwald | 415/55.1 X |
| 5,011,367 | * | 4/1991 | Yoshida et al. | 415/55.1 |
| 5,123,809 | * | 6/1992 | Ito | 415/55.1 |
| 5,174,713 | | 12/1992 | Iwai et al. | 415/55.1 |
| 5,209,630 | * | 5/1993 | Roth | 415/55.1 |
| 5,221,178 | | 6/1993 | Yoshioka et al. | 415/55.1 |
| 5,265,997 | * | 11/1993 | Tuckey | 415/55.1 |
| 5,372,475 | | 12/1994 | Kato et al. | 415/55.1 |
| 5,375,970 | | 12/1994 | Iwai et al. | 415/55.1 |

FOREIGN PATENT DOCUMENTS

| | | |
|---|---|---|
| 4-350394 | 12/1992 | (JP) . |
| 6-2690 | 1/1994 | (JP) . |
| 6-159283 | 6/1994 | (JP) . |

* cited by examiner

*Primary Examiner*—John E. Ryznic
(74) *Attorney, Agent, or Firm*—Sughrue, Mion, Zinn, Macpeak & Seas, PLLC

(57) ABSTRACT

Vane pieces (31) which are in an outer peripheral edge portion of an impeller (30) are divided into front and rear groups by a partition wall (32), and arranged in a staggered pattern, and outer peripheral faces of the vane pieces (31) are protruded toward the outer peripheral side with respect to the outer peripheral face of the partition wall (32). Therefore, fuel portions respectively entering vane grooves (33) which are divided into front and rear groups do not simultaneously collide against end faces (9*b*) of radial seal portions (9*a*). Consequently, the level of noises due to the fuel collision can be lowered. Furthermore, a reverse-flow region is prevented from being produced immediately above the partition wall (32). Therefore, the pump efficiency can be improved.

5 Claims, 6 Drawing Sheets

ELECTRIC FUEL PUMP

This is a Continuation of PCT Application No. PCT/JP98/05981, filed Dec. 28, 1998.

BACKGROUND OF THE INVENTION

1. Field of the Invention

The present invention relates to an electric fuel pump which is mounted in a fuel tank of an automobile or the like, and which forcedly delivers fuel to an engine, and particularly to an electric fuel pump in which the noise level can be lowered and the efficiency can be improved.

2. Description of the Related Art

FIGS. 6 and 7 are an enlarged partial perspective view of an impeller of an electric fuel pump of the conventional art which is disclosed in, for example, JP-B-63-63756, and an enlarged perspective view of the periphery of a radial seal portion of a pump base of the pump.

In the figures, 10 denotes the impeller which has many vane pieces 21 in an outer peripheral edge portion of a disk-like shape. The vane pieces 21 are divided into front and rear groups by a partition wall 22, and a vane groove 23 is formed between the vane pieces 21. The reference numeral 9 denotes the pump base which constitutes a pump casing (not shown), and which has an arcuate strip-like pump passage 13, a suction port 14, a discharge port 15, the radial seal portion 9*a* for preventing a reverse flow of fuel from occurring, and an end face 9*b* which changes the flow direction of the fuel.

When the impeller 10 is rotated in the pump casing (not shown), the fuel sucked from the suction port 14 flows into the vane grooves 23, is provided with a kinetic energy by the vane pieces 21, and then forcedly sent through the pump passage 13 toward the discharge port 15. The fuel which is forcedly sent to the discharge port 15 as described above collides against the end face 9*b* of the radial seal portion 9*a* which is formed in the final end of the pump passage, and is then discharged from the discharge port 15 while the direction is changed.

In this configuration, therefore, the fuel portions respectively entering the right and left vane grooves 23 which are divided into front and rear groups by the partition wall 22 simultaneously collide against the end faces 9*b* of the radial seal portions 9*a*. Consequently, the configuration has a problem in that the level of noises due to the fuel collision is high.

As a countermeasure against this problem, for example, known is the configuration which is disclosed in JP-A-60-173390 and shown in FIG. 8. In an impeller 10 of the configuration, vane pieces 21 on both the sides of a partition wall 22 are shifted from each other by ½ pitch, so that timings when the fuel portions respectively entering vane grooves 23 on both the sides of the partition wall 22 collide against end faces 9*b* of radial seal portions 9*a* are shifted from each other. As a result, the impact force due to the fuel collision is reduced, thereby lowering the noise level. The periphery of the radial seal portion is configured in the same manner as above-described FIG. 7.

In the configuration which is disclosed in JP-A-61-59283 and shown in FIGS. 9 and 10, a step 9*c* is disposed in an end face 9*b* of each radial seal portion 9*a* of a pump base 9 which constitutes a pump casing (not shown), whereby timings of fluid collision are shifted from each other to lower the noise level. Furthermore, the outer peripheral face of each vane piece 21 is protruded from that of a partition wall 22 in an outer peripheral direction, so that a reverse-flow region (a region where the pumping function is impeded) is prevented from being produced immediately above the partition wall 22, whereby the pump efficiency is improved.

Recently, needs for lowering the operating sound level and reducing fuel consumption are increasing. In order to satisfy the needs, in an electric fuel pump of the conventional art, a countermeasure in which the shape of an impeller is changed so as to lower the operating sound level as described above, or that in which the shape of an impeller is changed and the shape of a pump base is changed so as to lower the operating sound level and improve the pump efficiency is taken. From the viewpoints of dimensional accuracy and mechanical strength, however, a pump base is usually produced by aluminum die casting. Consequently, there is a problem in that modification or production of production dies is very expensive.

SUMMARY OF THE INVENTION

The invention has been conducted in order to solve the above-discussed problems. It is an object of the invention to provide an electric fuel pump in which the noise level during operation is lowered and the pump efficiency is high, without changing the shape of a pump base.

To achieve the above object, according to the invention, there is provided an electric fuel pump comprising: an impeller which has many vane pieces in an outer peripheral edge portion of a disk-like shape; a motor section which rotates the impeller; and a pump casing which houses the impeller, which forms an arcuate strip-like pump passage that elongates along the outer peripheral edge portion of the impeller, and which has a suction port in one end portion of the pump passage, and a discharge port in another end portion, wherein, in the impeller, the vane pieces which are divided into front and rear groups by a partition wall are arranged in a staggered pattern, and outer peripheral faces of the vane pieces are protruded toward an outer peripheral side with respect to an outer peripheral face of the partition wall.

Also, according to the invention, an inclined face wall of the partition wall is formed so that, as the inclined face wall approaches nearer to a side face wall of each of the vane pieces, a distance between the inclined face wall of the partition wall and an end face of the impeller on a side of the vane piece is further reduced.

Further, according to the invention, the inclined face wall of the partition wall is formed into a spherical shape.

Furthermore, as seeing each of the vane pieces in a circumferential direction, the vane piece stands with overlapping another adjacent vane piece.

Further, according to the invention, inner face walls of the vane pieces are formed to obliquely intersect with the outer peripheral face of the partition wall.

DETAILED DESCRIPTION OF THE PREFERRED EMBODIMENTS

Now, a description will be given in more detail of preferred embodiments of the invention with reference to the accompanying drawings.

Figure 1:
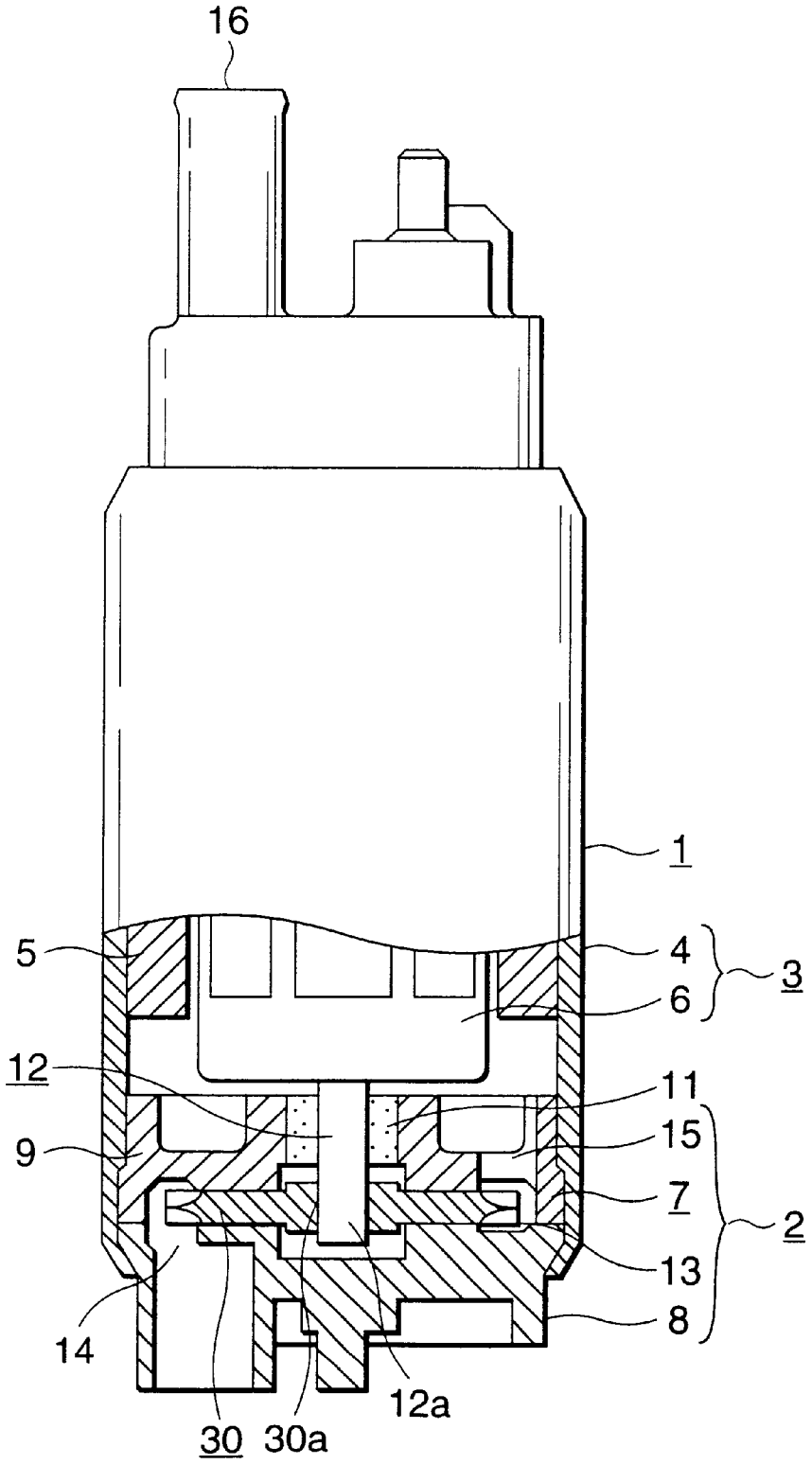
FIG. 1 is a side view showing an electric fuel pump of an embodiment of the invention, partially in section.
Figure 2:
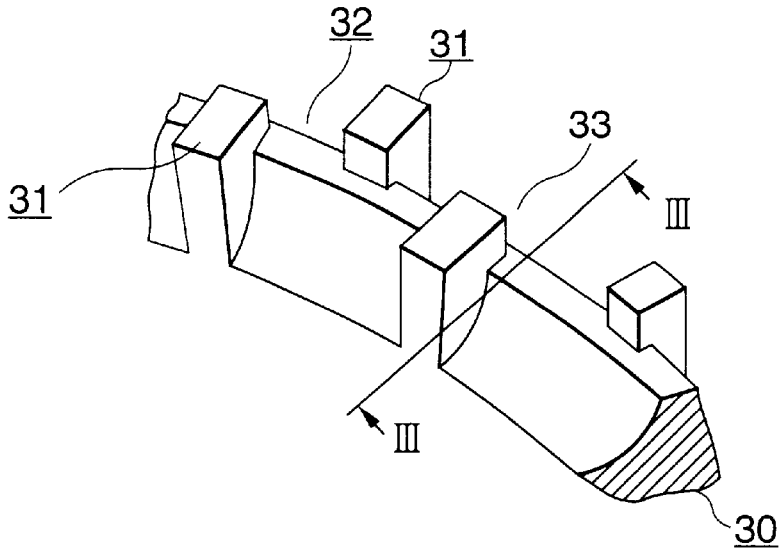
FIG. 2 is an enlarged perspective view of a vane piece portion of an impeller of the electric fuel pump of the embodiment of the invention.
Figure 3:
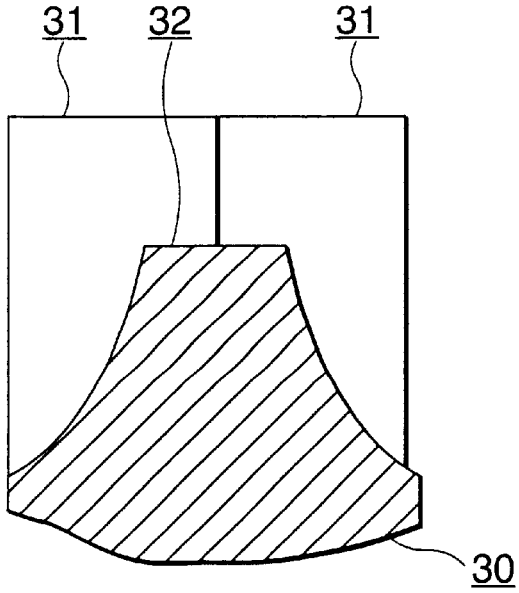
FIG. 3 is an enlarged section view of the vane piece portion of the impeller and taken along the line III—III of FIG. 2.

FIG. 1 is a side view showing an electric fuel pump of an embodiment of the invention, partially in section, FIG. 2 is an enlarged perspective view of a vane piece portion of an impeller, and FIG. 3 is an enlarged section view of the vane piece portion of the impeller and taken along the line III—III of FIG. 2. Hereinafter, description will be made with reference to FIGS. 1 to 3. The electric fuel pump 1 is configured by a pump section 2, and a motor section 3 which drives the pump section 2. For example, the motor section 3 is a DC motor having brushes which are not shown, and has a configuration in which permanent magnets 5 are annularly arranged in a cylindrical housing 4 and an armature 6 is concentrically placed on the inner peripheral side with respect to the permanent magnets 5.

The pump section 2 is configured by a pump casing 7 consisting of a pump cover 8 and a pump base 9, and an impeller 30 which is housed in the pump casing 7. The pump cover 8 and the pump base 9 are formed by, for example, aluminum die cast molding.

The pump base 9 is pressingly inserted and fixed to one end of the housing 4. A rotary shaft 12 which is formed integrally with the armature 6 is passed through and held by a bearing 11 which is fittingly attached to the center of the one end. By contrast, the pump cover 8 is fixed to one end of the housing 4 by crimping or the like under a state where the cover is put on the pump base 9.

An insertion hole 30*a* having a substantially D-like shape is formed in the center of the impeller 30. A D-cut portion 12*a* of the rotary shaft 12 is loosely inserted into the insertion hole 30*a*. According to this configuration, the impeller 30 is rotated integrally with the rotary shaft 12 and slidable in the axial direction.

Figure 7:
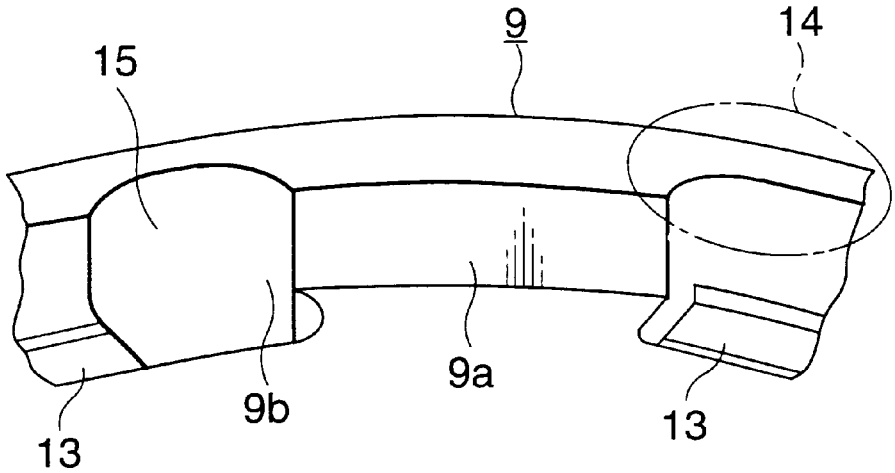
FIG. 7 is an enlarged perspective view of the periphery of a radial seal portion of a pump base of the electric fuel pump of the conventional art.

An arcuate strip-like pump passage 13 is formed in inner side faces of the pump cover 8 and the pump base 9 which form the pump casing 7. A suction port 14 which communicates with one end of the pump passage 13 is formed in the pump cover 8. A discharge port 15 which communicates with the pump passage 13 is formed in the pump base 9. A radial seal portion 9*a* (see FIG. 7) for preventing a reverse flow from occurring is formed between the suction port 14 and the discharge port 15. The discharge port 15 communicates with the space in the motor section 3, so that the fuel discharged from the discharge port 15 is passed through the motor section 3 and then forcedly delivered to an engine (not shown) via a fuel outlet pipe 16 which is adjacent to the motor section 3.

The impeller 30 is integrally formed by, for example, phenol resin or the like. Many vane pieces 31 which are protruded into the arcuate strip-like pump passage 13 are formed in the outer peripheral portion. The vane pieces 31 are divided into front and rear groups by a partition wall 32 and arranged in a staggered pattern. On the same face (the front face or the rear face), a vane groove 33 is formed between each of the vane pieces 31 and another adjacent vane piece 31. Outer peripheral faces of the vane pieces 31 are protruded toward the outer peripheral side with respect to the outer peripheral face of the partition wall 32.

Next, the operation of the thus configured electric fuel pump will be described.

When coils (not shown) of the armature 6 of the motor section 3 are energized, the armature 6 is rotated, so that the rotary shaft 12 which is formed integrally with the armature 6, and the impeller 30 having the insertion hole 30*a* which is engaged with the D-cut portion 12*a* of the rotary shaft 12 are rotated. Therefore, the vane pieces 31 which are in the outer peripheral portion of the impeller 30 are rotated along the arcuate strip-like pump passage 13, a turning flow is generated in the vane grooves 33, and the vane grooves 33 are rotationally moved in the pump passage 13, whereby the kinetic energy is increased to produce the pumping function.

As a result, the fuel in a fuel tank (not shown) is sucked into the pump passage 13 via the suction port 14, flows into the vane grooves 33, and is rotationally moved in the pump passage 13. Thereafter, the fuel is forcedly sent toward the discharge port 15, passed through the motor section 3, and then forcedly delivered to the engine (not shown) via the fuel outlet pipe 16.

The outer peripheral faces of the vane pieces 31 have a shape in which the faces are protruded toward the outer peripheral side with respect to the outer peripheral face of the partition wall 32, and a reverse-flow region (a region where the pumping function is impeded) is hardly produced immediately above the partition wall 32. Therefore, a turning flow is efficiently generated in each of the vane grooves 33, so that the pump efficiency is improved.

Each of the vane pieces 31 of the impeller 30 is shifted by ½ pitch with respect to an adjacent one of the vane pieces 31, so that timings when the fuel portions respectively entering the vane grooves 33 on the front and rear sides of the partition wall 32 collide against the end faces 9*b* (see FIG. 7) of the radial seal portions 9*a* are shifted from each other. As a result, the noise level in the fuel collision is lowered.

Figure 4:
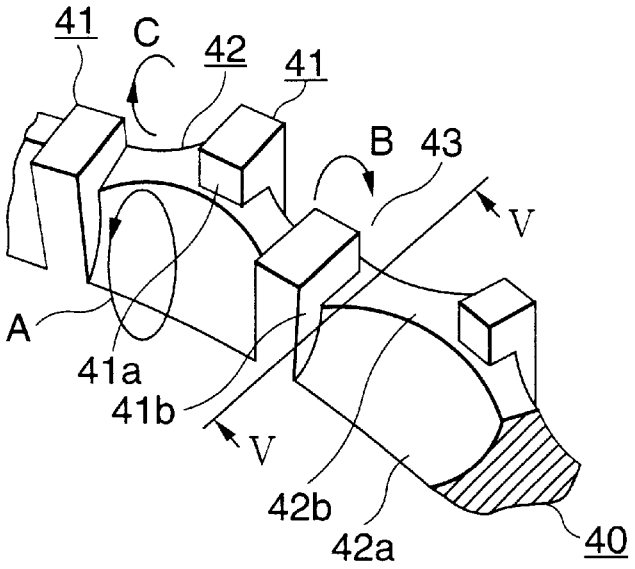
FIG. 4 is an enlarged perspective view of a vane piece portion of an impeller of an electric fuel pump of another embodiment of the invention.
Figure 5:
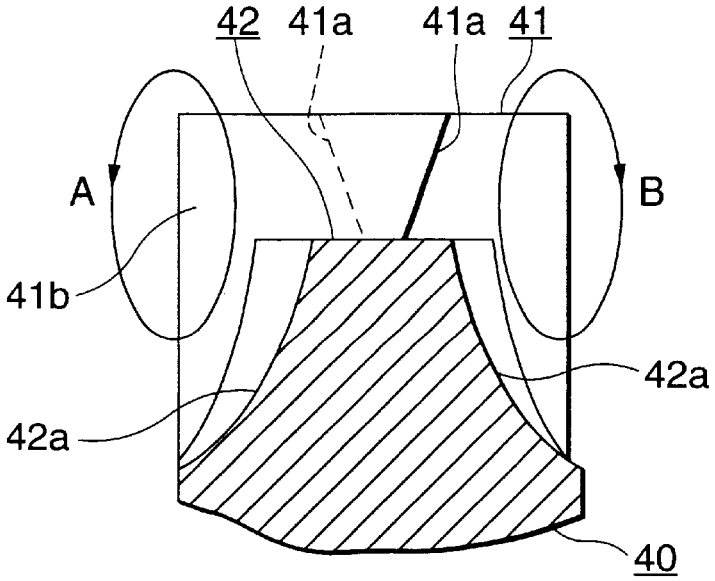
FIG. 5 is an enlarged section view of the vane piece portion of the impeller and taken along the line V—V of FIG. 4.

Next, another embodiment of the invention will be described. FIG. 4 is an enlarged perspective view of a vane piece portion of an impeller of the other embodiment of the invention, and FIG. 5 is an enlarged section view of the vane piece portion of the impeller and taken along the line V—V of FIG. 4. Hereinafter, description will be made with reference to FIGS. 1, 4, and 5.

In the figures, 40 denotes the impeller. The vane pieces 41, a partition wall 42, and vane grooves 43 are configured in the same manner as those of the embodiment described above. The reference numeral 41*a* denotes inner face walls, and 41*b* denotes side face walls which are formed on faces where the vane pieces 41 abut against the partition wall 42. The reference numeral 42*a* denotes inclined face walls corresponding to front and rear inclined faces of the partition wall 42, and 42*b* denotes leak grooves which are produced in the outer peripheral portion of the partition wall 42 and between each of the vane pieces 41 and one of the vane pieces 41 which is on the rear face side with respect to the vane piece.

Each of the inclined face walls of the partition wall is configured so that, as the inclined face wall approaches nearer to the side face wall of the corresponding one of the vane pieces, the distance between the inclined face wall of the partition wall and the end face of the impeller on the side of the vane piece is further reduced.

Each of the inclined face walls 42*a* of the partition wall 42 is formed so that, as the inclined face wall approaches nearer to the side face wall 41*b* of the corresponding one of the vane pieces 41, the distance between the partition wall 42 and the impeller face on the side of the vane piece 41 is further reduced. Preferably, the inclined face walls 42*a* are formed into a spherical shape. As seeing the vane pieces 41 in the circumferential direction, the vane pieces are arranged in positions where they overlap respective adjacent vane pieces, and in a staggered pattern. Each of the inner face walls 41*a* which intersects with the outer peripheral face of corresponding one of the vane pieces 41, and also with that of the partition wall 42 is formed so as to obliquely intersect with the outer peripheral face of the vane piece 41 and that of the partition wall 42.

Next, the operation will be described. The basic operation as an electric fuel pump is identical with that of the embodiment described above, and its description is omitted.

When the vane pieces 41 on the outer peripheral portion of the impeller 40 are rotated along the arcuate strip-like pump passage 13, turning flows A, B, and C (in FIG. 4, only three turning flows are shown) are generated in the vane grooves 43. The rotational movement of the vane grooves 43 in the pump passage 13 causes the kinetic energies of these turning flows A, B, and C to be increased, so that the pressure is raised and the pumping function is performed. In the pressure rising process, the turning flows are shifted from one another in rotational angle position in the pump passage 13, and a pressure difference is generated among the turning flows. Therefore, the fuel leaks from the higher pressure side to the lower pressure side through the leak grooves between the vane pieces 41. The fuel leakage prevents the pressure in the pump passage 13 from rising, and hence lowers the pump efficiency.

In the invention, the inclined face walls 42*a* of the partition wall 42 of the impeller 40 intersect with the side face walls 42*b* of the vane pieces 41 so that the thickness of the partition wall 42 is increased. When a turning flow is produced along the shape of one of the inclined face walls 42*a,* therefore, interference with another turning flow is reduced, whereby fuel leakage between turning flows is reduced, so that the pump efficiency can be improved. As seeing the vane pieces 41 in the circumferential direction, the vane pieces are arranged in positions where they overlap other respective adjacent vane pieces 41. When the impeller 40 is rotated, therefore, the overlapping portion of each of the side face walls 41*b* functions as a wall which prevents fuel leakage in the rotation direction from occurring. As a result, fuel leakage between turning flows which are generated in the vane grooves 43 is reduced, and the pump efficiency can be improved.

Moreover, the inner face wall 41*a* of each of the vane pieces 41 and intersecting with the partition wall 42 is formed so as to obliquely intersect from the outer peripheral face of the partition wall 42 with that of the vane piece 41. Each turning flow is smoothly formed along the inclination angle of the inner face wall 41*a*. Therefore, the pump efficiency can be improved.

Figure 6:
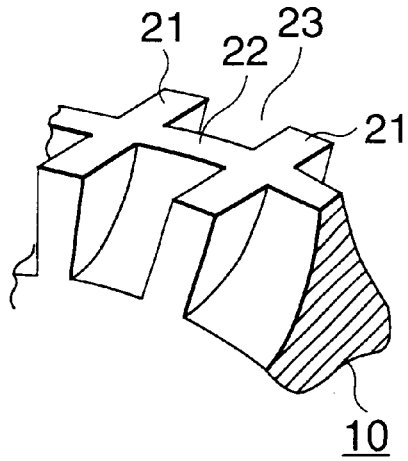
FIG. 6 is an enlarged perspective view of a vane piece portion of an impeller of an electric fuel pump of the conventional art.
Figure 8:
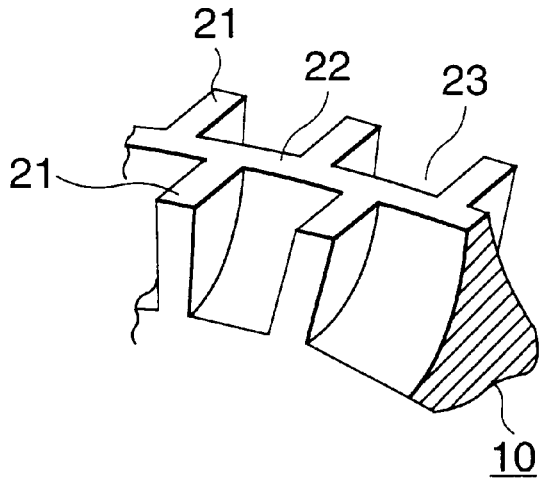
FIG. 8 is an enlarged perspective view of a vane piece portion of an impeller of an electric fuel pump of the conventional art.
Figure 9:
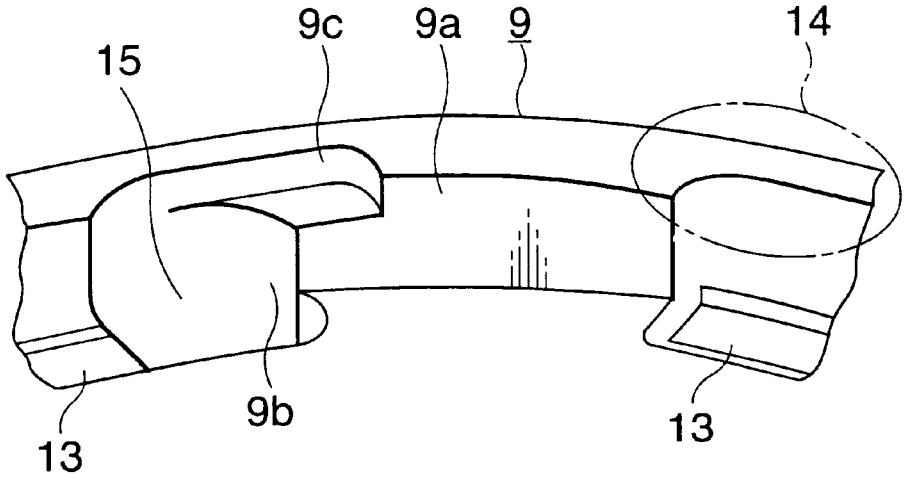
FIG. 9 is an enlarged perspective view of the periphery of a radial seal portion of a pump base of an electric fuel pump of the conventional art.
Figure 10:
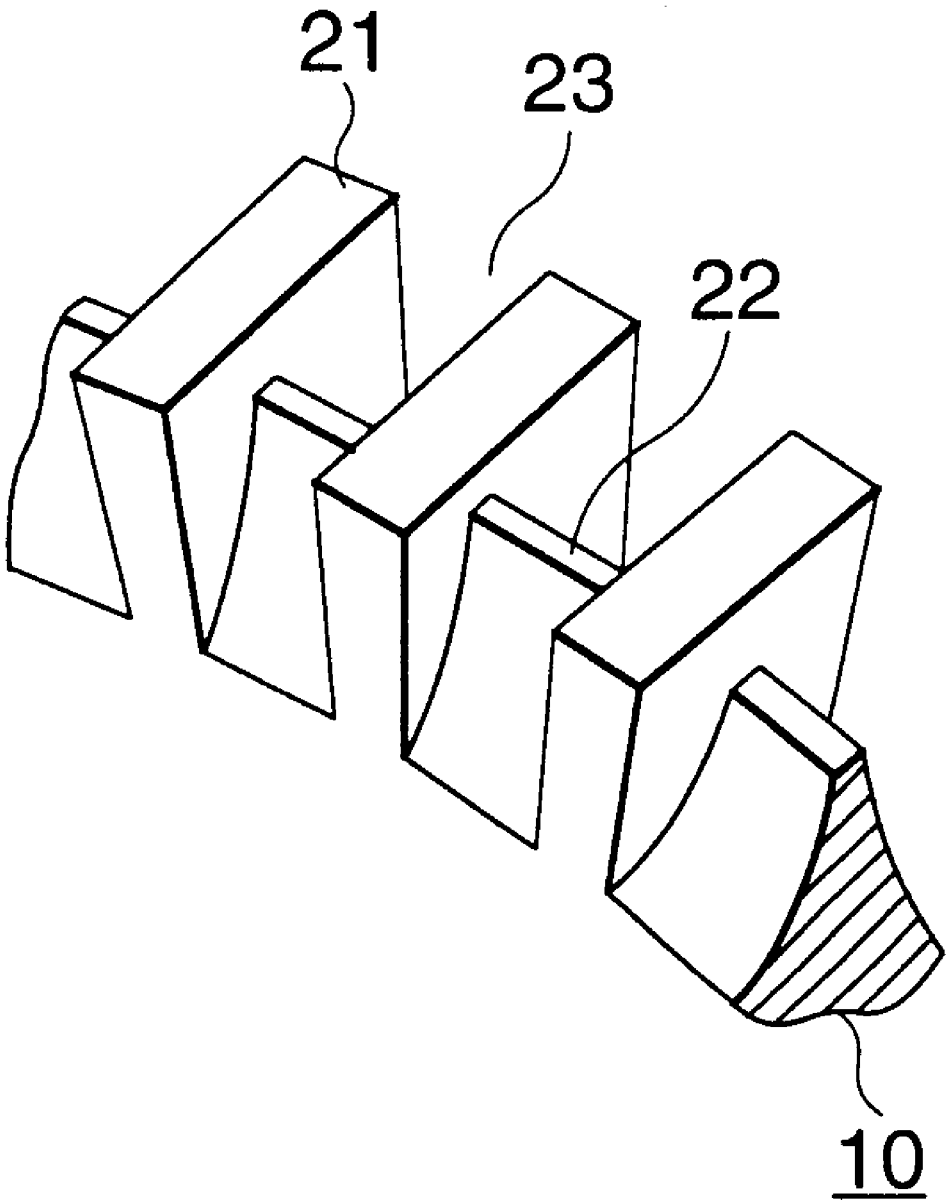
FIG. 10 is an enlarged perspective view of a vane piece portion of an impeller of the electric fuel pump of the conventional art.

In the above, the case where the impeller 40 has the shape in which the outer peripheral faces of the vane pieces 41 are protruded toward the outer peripheral side with respect to the outer peripheral face of the partition wall 42 has been described. In the impellers of the conventional art shown in FIGS. 6, 8, and 10, when the inclined face walls 42*a* of the partition wall 42 intersect with the side face walls 42*b* of the vane pieces 41 so that the thickness of the partition wall 42 is increased, fuel leakage between turning flows is reduced, and the pump efficiency can be improved.

In the electric fuel pump according to the invention, vane pieces of an impeller are divided into front and rear groups by a partition wall, and arranged in a staggered pattern, and outer peripheral faces of the vane pieces are protruded toward the outer peripheral side with respect to the outer peripheral face of the partition wall. Therefore, it is possible to obtain an electric fuel pump in which the noise level during operation is low and the pump efficiency is high, without changing the shape of a pump base.

Since an inclined face wall of the partition wall is formed so that, as the inclined face wall approaches nearer to a side face wall of each of the vane pieces, the distance between the inclined face wall of the partition wall and an end face of the impeller on the side of the vane piece is further reduced, fuel leakage is reduced, and the pump efficiency can be improved.

Since, as seeing each of the vane pieces of the impeller in a circumferential direction, the vane piece with overlapping another adjacent vane piece, fuel leakage is reduced, and hence the pump efficiency can be improved.

Since the inner face wall of each of the vane pieces of the impeller and intersecting with the partition wall is formed so as to obliquely intersect from the outer peripheral face of the partition wall with that of the vane piece, a turning flow is smoothly formed along the inclination angle of the inner face wall. Therefore, the pump efficiency can be improved.

As described above, in the electric fuel pump according to the invention, the shape of the impeller is changed, thereby enabling an electric fuel pump in which the noise level during operation is low and the pump efficiency is high, to be provided. The electric fuel pump can be used not only as a pump for an automobile, but also as a pump for forcedly delivering a fluid such as water.

What is claimed is:

1. An electric fuel pump comprising:

an impeller which has many vane pieces in an outer peripheral edge portion of a disk-like shape;

a motor section which rotates said impeller; and a pump casing which houses said impeller, which forms an arcuate strip-like pump passage that elongates along said outer peripheral edge portion of said impeller, and which has a suction port in one end portion of said pump passage, and a discharge port in another end portion, wherein, in said impeller, said vane pieces which are divided into front and rear groups by a partition wall are arranged in a staggered pattern, and outer peripheral faces of said vane pieces are protruded toward an outer peripheral side with respect to an outer peripheral face of said partition wall.

2. An electric fuel pump according to claim 1, wherein an inclined face wall of said partition wall is formed so that, as said inclined face wall approaches nearer to a side face wall of each of said vane pieces, a distance between said inclined face wall of said partition wall and an end face of said impeller on a side of said vane piece is further reduced.

3. An electric fuel pump according to claim 2, wherein said inclined face wall of said partition wall is formed into a spherical shape.

4. An electric fuel pump according to claim 1, wherein, as seeing each of said vane pieces of said impeller in a circumferential direction, said vane piece stands with overlapping another adjacent vane piece.

5. An electric fuel pump according to claim 4, wherein inner face walls of said vane pieces are formed to obliquely intersect with said outer peripheral face of said partition wall.

* * * * *